United States Patent [19]

Aldridge et al.

[11] 4,199,744

[45] Apr. 22, 1980

[54] MAGNETIC CORE WITH MAGNETIC RIBBON IN GAP THEREOF

[75] Inventors: Tomm V. Aldridge; Richard M. Haas, both of Visalia, Calif.

[73] Assignee: Sprague Electric Company, North Adams, Mass.

[21] Appl. No.: 462

[22] Filed: Jan. 2, 1979

[51] Int. Cl.[2] ..... H01F 17/06; H01F 27/24

[52] U.S. Cl. ..... 336/178; 336/233

[58] Field of Search ..... 336/165, 178, 212, 219, 336/233, 176, 160

[56] References Cited

U.S. PATENT DOCUMENTS

| | | | |
|---|---|---|---|
| 3,212,006 | 10/1965 | McQuarrie | 336/178 X |
| 3,360,753 | 12/1967 | Wroblewski | 336/165 |
| 3,725,832 | 4/1973 | Schweitzer, Jr. | 336/176 V |
| 3,748,618 | 7/1973 | Kaiserwerth et al. | 336/178 |

*Primary Examiner*—Thomas J. Kozma

*Attorney, Agent, or Firm*—Connolly and Hutz

[57] ABSTRACT

A ferrite toroid has two radially extending gaps. Into each gap there is inserted an insulative shim having a magnetic metal ribbon folded over the shim. When current is applied to a winding on the core, the resultant magnetic flux is steered into the magnetic ribbons and around the gaps. For high frequency excitations eddy current losses in the ribbons are high and the windings have low Q but high inductance. At high winding currents, the magnetic ribbons are saturated, the inductance is reduced and the Q of the winding increases. In a switching voltage regulator, this inductor tends to generate only a small amount of ringing and electromagnetic radiation noise.

7 Claims, 10 Drawing Figures

Fig.1.
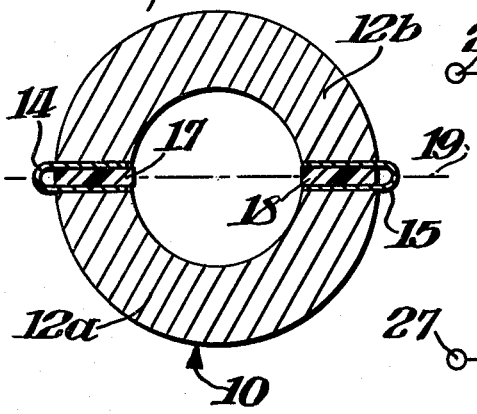
Fig.2.
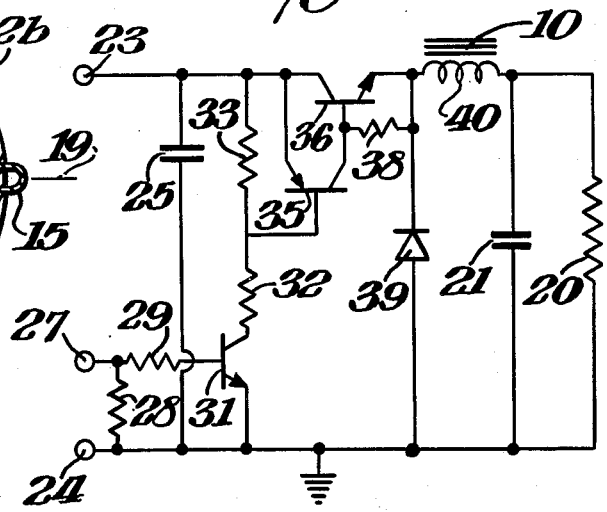
Fig.3.
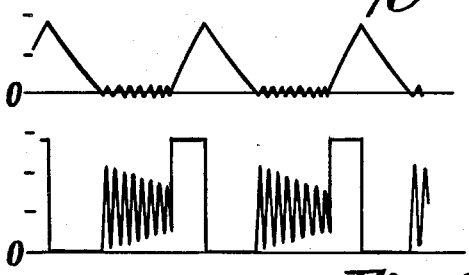
Fig.7.
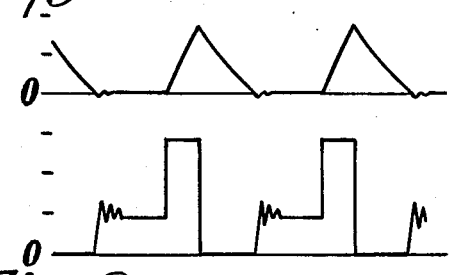
Fig.4.
Fig.8.
Fig.5.
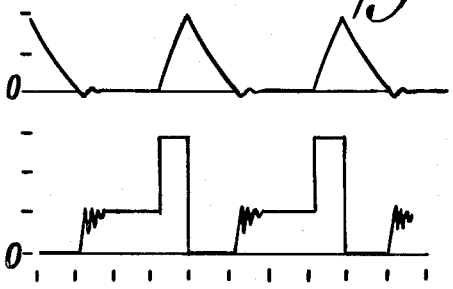
Fig.9.
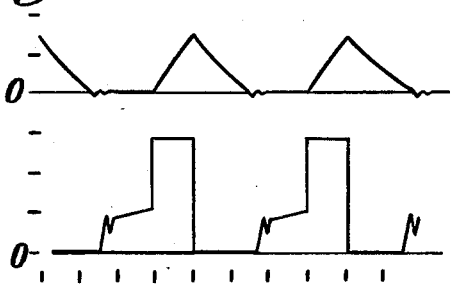
time (10μsec./div.) Fig.6.
Fig.10. time (10μsec/div.)

MAGNETIC CORE WITH MAGNETIC RIBBON IN GAP THEREOF

BACKGROUND OF THE INVENTION

This invention relates to a magnetic core for use in a wound-core electrically-inductive component, and more particularly to a gapped magnetic annulus having a magnetic metal ribbon shunt in the gap.

Annular cores are often used in inductors to provide a high inductance in a physically small inductor. When the inductive component is to be excited by a large or unsymmetrical current, or a DC excitation is to be used, then the annular core is often gapped to prevent premature core saturation of latching up. Such a gapped core may result in a compromised but still high ratio of inductance to physical size.

However, there are two distinct mechanisms that can detract from the desirability of employing gapped annular cores. One consists in fringing magnetic fluxes radiating from a core gap which may induce unwanted voltages in adjacent components or circuits, causing what is more generally called electromagnetic interference (EMI). The other mechanism is evident when an inductance having a gapped core that generally exhibits a high quality factor (Q) over a broad range of frequencies, is excited by pulses of high current, and high frequency oscillations occur which exacerbate EMI radiation.

A toroidal core comprised of annular iron laminations stacked with a gapped ferrite annulus has been taught to provide relatively EMI-free performance as a filter component in a silicon control rectifier AC power controller circuit.

It is an object of the present invention to provide an improved low cost gapped core for an inductive component producing a minimum of EMI.

It is a further object of the present invention to provide such a core being composed substantially of a relatively low cost ferrite material and only a small amount of magnetic metal.

It is more particularly an object of the present invention to provide such a core for use in a high performance switching voltage-regulator circuit.

SUMMARY OF THE INVENTION

A magnetic core is comprised of an annular magnetic piece having at least one gap that extends at least part way through the piece. Included in the gap is a U-shaped magnetic metal ribbon. The two arms of the U-shaped ribbon are adjacent the two opposing faces of the gap, respectively.

When a wire coil is wound on this core, the inductance of the coil is higher for low coil currents than at high coil currents. Furthermore the coil Q is lower at low coil currents than at high coil currents, primarily due to strong eddy currents in the conducting magnetic metal ribbon. Also, the resonant frequency of this coil will be lower at small operating currents. Consequently the tendency for ringing oscillations to occur in a switching voltage regulating circuit incorporating this wound coil is greatly reduced; the efficiency remains high and the output ripple voltage remains low. Furthermore, what ringing does occur is at a lower frequency. Thus the potential EMI generated by a switching voltage regulator incorporating a core of this invention is greatly reduced.

BRIEF DESCRIPTION OF THE DRAWING

FIG. 1 shows in cross section a toroidal core of the present invention.

FIG. 2 shows a circuit diagram of a pulse controlled DC power supply including an inductor wound on the core of FIG. 1.

FIGS. 3 and 4 show inductor current and diode voltage wave forms, respectively, in the circuit of FIG. 2 with an airgapped core substituted for the core of FIG. 1.

FIGS. 5 and 6 show inductor current and diode voltage waveforms, respectively, in the circuit of FIG. 2 wherein there is substituted for the core of FIG. 1, a gapped core having brass shunts in the gaps.

FIGS. 7 and 8 show inductor current and diode voltage wave forms, respectively, in the circuit of FIG. 2, the core gap shunts being made from a nickel-iron alloy ribbon.

FIGS. 9 and 10 show inductor current and diode voltage wave forms, respectively, in the circuit of FIG. 2, the core gap shunts being made from a silicon-iron alloy ribbon.

DESCRIPTION OF THE PREFERRED EMBODIMENTS

The core 10 of FIG. 1 is composed of a double gapped ferrite toroid, consisting of two halves **12*a* and 12*b* with shunts in the gaps. The shunts are made by folding magnetic metal ribbons, 14 and 15, about insulating shims 17 and 18, respectively. The toroid halves 12*a* and 12*b*** were made by cutting a standard ferrite toroid number 846T250-3C8 made by Ferrox-cube Corp., Saugerties, N.Y. The material (3C8) has a small-signal magnetic permeability of about 2700. The gap faces have an area of 0.27 square centimeters. This toroid saturates at about 3700 gauss.

In a series of four experiments, the two ferrite halves **12*a* and 12*b* were combined to form four different gapped core structures, respectively. In the first, the core halves were placed together with a shim of non-magnetic insulating material between them to form two "air" gaps. In the second, 2 mil (0.005 cm) thick brass ribbons were folded over insulating non-magnetic shims and placed in the gaps in the fashion illustrated in FIG. 1. In a third experiment, exemplifying a core of this invention, each of the two gaps between the ferrite halves 12*a* and 12*b* contained a glass-epoxy shim 17 or 18 and a 4 mil (0.010 cm) thick ribbon 14 or 19 of 50% nickel-50% iron, namely alloy #4750 made by Allegheny Ludlum Steel Corp., Pittsburg, Pennsylvania. The gaps between the same ferrite halves in the fourth experiment contained glass-epoxy shims 17 and 18** each having a 6 mil (0.015 cm) thick ribbon of 3% silicon-97% iron alloy, namely SELECTRON type M-6 made by Arnold Engineering Co., Marengo, Illinois. In each case the core parts were glued together but a permanent clamp would also be feasable.

In each experiment, the same 0.015 inch (0.038 cm) thick epoxy-glass shims were used so that when the composite dual gapped core was wound with 50 turns of (AWG #20) wire, the small signal inductance was very nearly 90 micro-henries ($\mu$H) when 1 ampere of DC current flowed in the winding causing any magnetic ribbon in the gaps to saturate. (More than 5 amps is required to saturate the ferrite.)

Each "90 $\mu$H" inductor, in turn, was placed in the circuit shown in FIG. 2. This circuit represents a portion of a typical switching voltage-regulator type DC power supply. The regulated DC voltage, about 5 volts, is developed across a load represented by resistor 20, which is shunted by a filter capacitor 21. During operation, a 15 volt DC power source is connected between the plus supply terminal 23 and the ground terminal 24, and is thus shunted by a filter capacitor 25. A source of positive 5 volt pulses (not shown) are connected to terminal 27 and the ground terminal 24. The pulses are connected by the network of resistors 28 and 29 to the base of transistor 31, which is turned on for the duration of each pulse. Through the voltage divider network of resistors 32 and 33, pulse current in the collector of transistor 31 enables transistor 35 which in turn causes the series transistor 36 to conduct for the duration of each input pulse of terminal 27. Resistor 38 serves to prevent the base of transistor 36 from "floating" in the interval between pulses. The inductor coil 40, of 50 turns on core 10, is connected in series with transistor 36 and load 20. A clamping Schottky diode 39 provides a return path for currents generated by a collapsing field in the core 10 in the interval between pulses.

In the Table I below, the components used in the circuit of FIG. 2 are further identified.

Table I

| | | |
|---|---|---|
| Transistors | 31 | 2N3859A |
| | 35 | 2N4403 |
| | 36 | 2N5038 |
| Diode | 39 | 1N5831 |
| Resistors | 20 | 25 ohms |
| | 28 | 62 |
| | 29 | 300 |
| | 32 | 4.7K |
| | 33 | 680 |
| | 38 | 22 |
| Capacitors | 21 | 2200μF |
| | 25 | 1000μF |

In a switching voltage-regulator the source of pulses is a part of a controller that senses the output voltage and changes either the repetition rate of the pulses or the pulse widths to hold the output voltage constant with changing input voltage at terminal 23 or changing load (i.e., changing values of the load resistor 20). However, for the experiments described herein, no such regulating feedback means were employed. In each of the four experiments the pulse repetition rate was 25 KHz and the pulse widths were adjusted in each experiment to produce 5 volts DC across the load 20.

Oscilloscope pictures were made in each experiment of the voltage appearing across the diode 39 (illustrated in FIGS. 4, 6, 8 and 10) and of the wave forms of current flowing in the inductor coil 40 (illustrated in FIGS. 3, 5, 7 and 9). The amplitude scales are 5 volts per vertical division and 0.5 amps per vertical division, respectively. Following the wave forms in real time from left to right, the inductor current decays to zero from a maximum value of 0.8 amp to 1.0 amp. Subsequently oscillations of about 300 KHz appear in the voltage wave form during the period of zero current. These two periods correspond to a time interval between the pulses applied in terminal 27. In a third period, corresponding to the presence of a pulse, the inductor current rises, the voltage across the diode assuming nearly the value of the DC input voltage (15 V).

The large oscillations in FIG. 4 for the simple "air" gapped core, are seen to be substantially attenuated in the remaining voltage wave forms and are progressively smaller in FIGS. 6, 8 and 10. The magnitude of these oscillations is a direct measure of the potential EMI that each circuit tends to produce.

The great reduction of oscillations in the second, third and fourth experiments is attributed to eddy current damping in the conducting metal ribbons that are positioned directly within the gaps.

In a further series of measurements, the 25 KHz ripple voltage developed across the load resistor 20 was measured, the results being shown in Table II.

Table II

| Core Gap | Ripple Voltage1 |
|---|---|
| "air" | 200 mv |
| brass | 280 mv |
| Ni-Fe | 210 mv |
| Si-Fe | 200 mv |

The magnetic ribbons used here have a permeability of about 10000 and, until saturated, the coil inductance is much larger than when ultimately saturated. Further, for low or zero coil current the flux density in the unsaturated magnetic ribbon is very high and so the eddy current losses are greater than in brass which does not concentrate the field. Consequently, the Q's in the unsaturated magnetic ribbon is lower and the ability of the cores employing magnetic ribbons to attenuate unwanted ringing oscillations is greater.

The brass ribbons in the core gaps of the second described experiment effect a substantial reduction in the unwanted oscillations in the circuit. However, the current wave forms in this experiment show a non-linear rise and fall of charging and discharging currents in a manner indicating that the overall losses in this core plus brass structure are greatest, degrading the power efficiency of the circuit. Further, the output ripple voltage is significantly higher using the non-magnetic brass ribbons in the gaps, which is not fully understood. Thus, a magnetic-metal ribbon, such as those used in the third and fourth experiments, effects substantial improvement. It is postulated that a gap formed only part way through the magnetic toroid and including the U-shaped magnetic metal ribbons in the gap would also be effective. Also, though two gaps are convenient as illustrated here, one or any number of gaps may be used.

Although the preferred embodiment of this invention employs a gapped ferrite toroid, the magnetic core may take other annular forms and be of other magnetic materials. The term annular as used herein means looped or circuiting; and an annular magnetic piece for use in a core of this invention not only includes a ferrite toroid. For example a ferrite "pot" core would be suitable wherein the gap is formed in the center post. Laminated steel cores may be used such as a doubly gapped "C" and "I" pair, or a singly gapped "E" and "I" pair. The magnetic permeability of the core material is preferably no less than 100 to concentrate the magnetomotive force in the gaps.

What is claimed is:

1. A magnetic core for use in a wound-core electrically-inductive component comprising an annular magnetic piece having at least one gap that extends at least part way through said piece; and a U-shaped magnetic metal ribbon in said gap with the two arms of said U-shaped ribbon being adjacent the two opposing faces of said gap, respectively.

2. The core of claim 1 wherein said ribbon is formed in said U-shape by being folded about an insulative non-magnetic shim.

3. The core of claim 1 wherein said ribbon is selected from silicon-iron and nickel-iron.

4. The core of claim 1 wherein said annular magnetic piece is ferrite.

5. The core of claim 4 wherein the magnetic permeability of said ferrite is about 2700.

6. The core of claim 1 additionally comprising a wire coil being wound on said core.

7. The core of claim 1 wherein the permeability of said annular magnetic piece is no less than 100.

* * * * *